US006244748B1

(12) United States Patent
Kasai et al.

(10) Patent No.: US 6,244,748 B1
(45) Date of Patent: Jun. 12, 2001

(54) PLASTIC PACKAGE WITH FASTENER

(75) Inventors: Juichi Kasai, Tokyo; Yoshihiro Tomomoto, Osaka; Osamu Uemura, Kanagawa, all of (JP)

(73) Assignee: Showa Highpolymer Co., Ltd., Tokyo (JP)

( * ) Notice: Subject to any disclaimer, the term of this patent is extended or adjusted under 35 U.S.C. 154(b) by 0 days.

(21) Appl. No.: 09/269,575

(22) PCT Filed: Oct. 1, 1996

(86) PCT No.: PCT/JP96/02856

§ 371 Date: Mar. 30, 1999

§ 102(e) Date: Mar. 30, 1999

(87) PCT Pub. No.: WO98/14383

PCT Pub. Date: Apr. 9, 1998

(51) Int. Cl.[7] ..... B65D 33/16

(52) U.S. Cl. ..... 383/203; 383/61; 383/95; 383/210

(58) Field of Search ..... 383/210, 211, 383/66, 93, 95, 203, 204, 61

(56) References Cited

U.S. PATENT DOCUMENTS

| | | | | |
|---|---|---|---|---|
| 4,572,377 | * | 2/1986 | Beckett | 383/95 |
| 5,077,064 | * | 12/1991 | Hustad et al. | 383/63 |
| 5,435,864 | * | 7/1995 | Machacek et al. | 383/61 |
| 5,601,368 | * | 2/1997 | Bodolay et al. | 383/61 |
| 5,672,009 | * | 9/1997 | Malin | 383/61 |
| 5,806,984 | * | 9/1998 | Yeager | 383/204 |
| 5,829,884 | * | 11/1998 | Yeager | 383/61 |
| 5,954,433 | * | 9/1999 | Yeager | 383/61 |
| 6,012,844 | * | 1/2000 | Huseman et al. | 383/93 |

FOREIGN PATENT DOCUMENTS

| | | |
|---|---|---|
| 302 144 | 2/1989 | (EP) . |
| 48-9623 | 3/1973 | (JP) . |
| 53-4965 | 2/1978 | (JP) . |
| 59-22743 | 2/1984 | (JP) . |
| 60-31705 | 7/1985 | (JP) . |
| 3-105450 | 10/1991 | (JP) . |
| 4-253644 | 9/1992 | (JP) . |
| 5-46748 | 6/1993 | (JP) . |
| 6-31097 | 4/1994 | (JP) . |

* cited by examiner

*Primary Examiner*—Stephen P. Garbe
(74) *Attorney, Agent, or Firm*—Sughrue, Mion, Zinn, Macpeak & Seas, PLLC

(57) ABSTRACT

A plastic package with a fastener composed of a plastic package body and a sealing sheet disposed in an internal portion of the package, wherein a first side of the package body and the sealing sheet are capable of being opened and closed by the fastener at an inlet portion of the package body, and a second side of the package body and the sealing sheet are sealed and the first side of the package body and the sealing sheet are bonded by peelable bonding portion(s) at a more internal side and/or external side of the package than the fastener. The package of the present invention has excellent filling, opening and resealing abilities even if the contents are liquid, as well as excellent pressure resistance.

18 Claims, 3 Drawing Sheets

PLASTIC PACKAGE WITH FASTENER

TECHNICAL FIELD

The present invention relates to a plastic package with a fastener applicable to common packing material such as foods and drinks, pharmaceuticals, stationery, mechanical parts, electronic parts or the like, and in particular to a plastic package with a fastener having excellent filling, opening and resealing characteristics even if the content is liquid, and excellent pressure resistance that enables a large volume of contents to be filled, as well as, excellent transportation stability and shelf-life.

BACKGROUND ART

In filling a content, for example a liquid, into a conventional plastic package with a fastener by using an automatic plugger, an inlet portion of the package is heat-sealed leaving a bottom portion of the package open, the content is filled from the bottom portion and the bottom portion is heat-sealed to ensure complete sealing of the packing and protect the fastener. For easy opening, a notch for cutting with scissors, perforation, or tape for tearing is provided at an upper portion of the heat-sealed inlet portion.

As described above, the content has to be filled from the bottom portion of the conventional plastic package with the fastener to prevent the content from attaching to the fastener and catching in groove of the fastener, and to keep the package quality from being degraded by the contents which are tacky or putrescent and colored.

On the other hand, a large volume plastic package such as a gusseted bag, a standing pouch, a laminated paper pack, a thermoplastic resin and the like are rarely used as a plastic package with a fastener because the contents cannot be filled from a bottom portion in view of the structure thereof and have to be filled from an inlet side of the package, and the fastener becomes contaminated. Accordingly, most conventional plastic packages with a fastener are flat bags having a small volume.

An easy to open package without a fastener has problems in terms of its transportation stability, shelf-life or the like because an inlet portion thereof is easily opened by internal pressure, thus limiting its usage. This phenomenon is especially apparent in a large volume package having a large ratio of content volume/packing material area. Yet, durability against internal pressure and easy to open characteristic cannot be compromised.

Consequently, there is a need for a large volume plastic package with a fastener having a large ratio of content volume/packing material area such as a gusseted bag, a standing pouch, a paper pack or the like, while being easy to open, capable of being resealed and not easily opened at the inlet portion by internal pressure.

An object of the present invention is to provide a plastic package with a fastener having excellent filling, opening and resealing characteristics even if the content is liquid and excellent pressure resistance that enables filling a large volume of contents, as well as, excellent transportation stability and shelf-life.

DISCLOSURE OF THE INVENTION

Through the intensive research of the present inventors, the above-described conventional problems have been solved.

According to the present invention, a plastic package with a fastener having a flexible package body and a sealing sheet disposed in an internal portion of the package body, wherein a first side of the package body and the sealing sheet are capable of being opened and closed by the fastener made of plastic at an inlet portion of the package body, and a second side of the package body and the sealing sheet are sealed and the first side of the package body and the sealing sheet are bonded by a peelable bonding portion at a side of the package that is more inside than the plastic fastener is provided.

In addition, according to the present invention, a plastic package with a fastener having a flexible package body and a sealing sheet disposed in an internal portion of the package body, wherein a first side of the package body and the sealing sheet are capable of being opened and closed by the fastener made of plastic at an inlet portion of the package body, and a second side of the package body and the sealing sheet are sealed and the first side of the package body and the sealing sheet are bonded by a peelable bonding portion at a side of the package more external than the plastic fastener is provided.

Furthermore, according to the present invention, a plastic package with a fastener having a flexible package body and a sealing sheet disposed in an internal portion of the package body, wherein a first side of the package body and the sealing sheet are capable of being opened and closed by the fastener made of plastic at an inlet portion of the package body, and a second side of the package body and the sealing sheet are sealed and the first side of the package body and the sealing sheet are bonded by peelable bonding portions at more external and internal sides of the package than the plastic fastener is provided.

According to the plastic package with the fastener of the present invention, the peelable bonding portion is disposed parallel to the plastic fastener.

Also according to the plastic package with the fastener of the present invention described above, a tear line is disposed between the plastic fastener and a seal which is between the first side of the package body and the sealing sheet.

Yet further, according to the plastic package with the fastener of the present invention described above, a distance between the plastic fastener and the peelable bonding portion, which is disposed at a more internal or external portion of the package than the plastic fastener, is at least 0.5 mm.

According to the plastic package with the fastener of the present invention described above, the second side of the package body and the sealing sheet are sealed at a portion that is at least 2 mm above (upper outlet side) an end of a contents side (lower) of the peelable bonding portion which is disposed at a more internal or external portion of the package than the plastic fastener.

Additionally, according to the plastic package with the fastener of the present invention described above, the plastic package with the fastener is a gusseted bag, a standing pouch or a laminated paper pack.

Moreover, according to the present invention, a method for filling contents into a plastic package with a fastener comprises the steps of: filling the contents from an inlet side of the plastic package with the fastener and sealing a second side of a package body and a sealing sheet.

BEST MODE FOR CARRYING OUT THE INVENTION

As a material used in the package of the present invention, a substance identical to a plastic fastener (hereinafter referred to simply as "fastener") or a plastic sheet which exhibits good adhesion with the fastener is generally used. Although not limited thereto, thermoplastic resins such as low density polyethylenes, high density polyethylenes, polypropylenes, polyesters, polyamides, polyvinyl chlorides and the like are commonly used. Depending on the size and intended use of the package, these plastic sheets are laminated, the sheets are laminated with paper or aluminum foil, or metal or metallic oxide is vapor deposited on the sheets.

As for the shape of the package, one having a large volume and a large ratio of content volume/packing area, for example, a gusseted bag, a standing pouch, a flat bag, a paper pack of a resin laminated onto paper and the like is preferably used in the present invention.

The thickness of the package body or the sealing sheet is selected freely depending on the size and intended use of the package of the present invention.

Referring to the figures, an embodiment of the present invention will be described.

Figure 1:
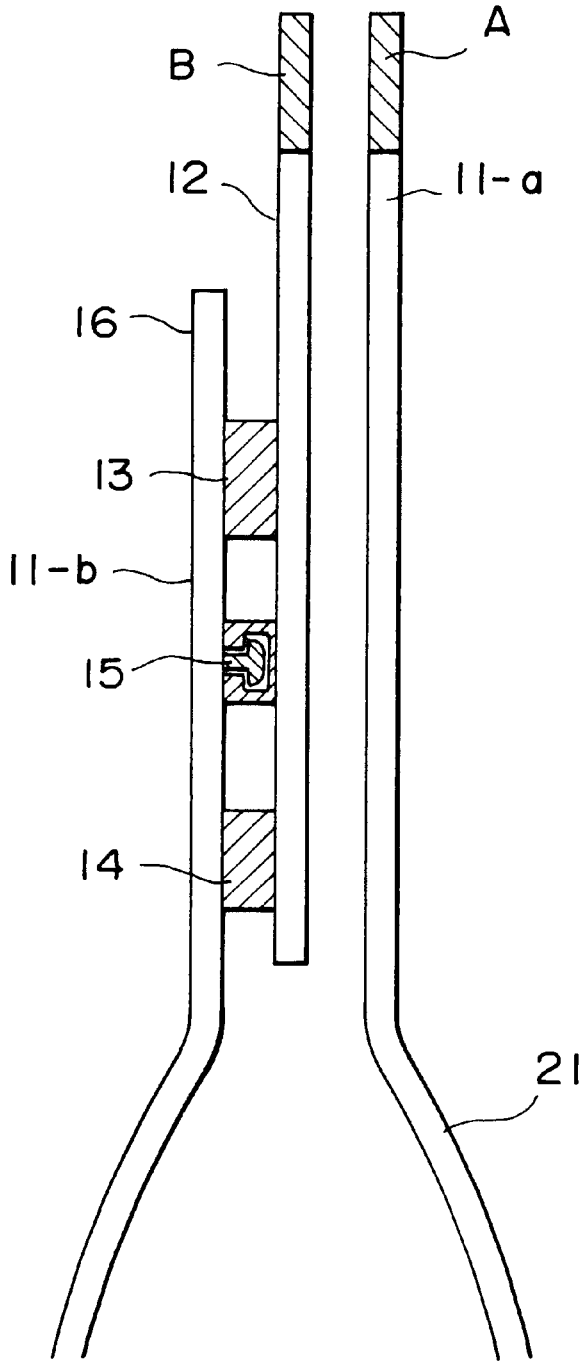
FIG. 1 is an enlarged cross-sectional view of an inlet portion of a package (standing pouch) according to one embodiment of the present invention.
Figure 2:
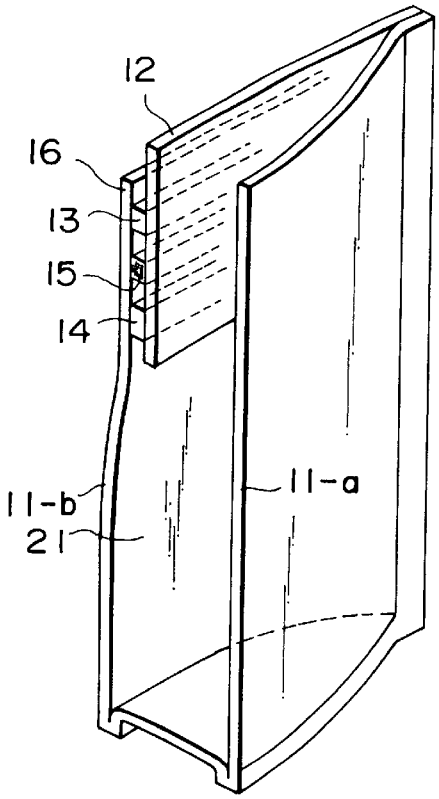
FIG. 2 is a cross-sectional view of the standing pouch of FIG. 1.

FIG. 1 is an enlarged cross-sectional view of an inlet portion of a package (standing pouch) according to one embodiment of the present invention. FIG. 2 is a cross-sectional view of the standing pouch of FIG. 1.

In FIGS. 1 and 2, a package body 21 is composed of a flexible first sheet 11-*b* and a second sheet 11-*a*, a tongue in a fastener 15 is disposed along the entire width of the package on the first sheet 11-*b* of the package body and a corresponding groove is disposed on a sealing sheet 12. Conversely, the groove may be disposed on the first sheet 11-*b* and the tongue may be disposed at the sealing sheet 12. The sealing sheet 12 is disposed between the sheets 11-*a* and 11-*b* of the package body, extending internally into the package (the content side in the package). A peelable bonding portion 14 is formed at a lower side (internal side of the package) of the fastener 15 between the first sheet 11-*b* of the package body and the sealing sheet 12. Preferably, the peelable bonding portion 14 is formed parallel to the fastener. A peelable bonding portion 13 can be formed at an upper side (external side of the package) of the fastener 15, which is also a preferred embodiment. The peelable bonding portion 13 alone may be formed at the upper side of the fastener 15 without forming the bonding portion 14, although such an embodiment is not shown. The peelable bonding portion 13 or 14, or portions 13 and 14 can be formed at a desired place by part coating or co-extruding, for example, a heat seal resin. As the heat seal resin, any known type of resin can be used unless the adhesion strength thereof is too high, and an interface peeling type, cohesive failure type or the like may be used singly or in combination.

Examples of the heat seal resin include ethylene-vinyl acetate copolymers, vinylidene chloride resins, modified polypropylene resins, modified polyethylene resins and the like.

The peelable bonding portion 13 or 14, or portions 13 and 14, are disposed 0.5 mm or more, preferably 1 mm or more apart from the fastener. With a distance of less than 0.5 mm, the fastener may be thermally affected and deformed. The width of the peelable bonding portion 13 or 14, or portions 13 and 14, is preferably 2 mm or more.

After the contents are filled into the package, an upper portion A of the sheet 11-*a* and an upper portion B of the sealing sheet 12 are sealed at least 2 mm above (upper outlet side) an end (lower) of the contents side of the peelable bonding portion 14 to obtain durability against internal pressure. In the case of disposing the peelable bonding portion 13 only and not disposing the bonding portion 14, the portions A and B are sealed at least 2 mm above (upper outlet side) an end (lower) of the content side of the bonding portion 13.

Thus, according to the package of the present invention, the contents can be filled between the upper portion A of the sheet 11-*a* and the upper portion B of the sealing sheet 12. Therefore, even if the content is an adhesive and tacky liquid, the fastener is kept closed so that the fastener portion is not contaminated. Moreover, the case when a contents side (lower) of the fastener 15 is protected by the peelable bonding portion 14, the contents never directly contacts the fastener 15 after sealing. Consequently, a package having excellent transportation stability, shelf-life and the like, as well as, durability against internal pressure is realized. The types of sealing between the upper portion A of the sheet 11-*a* and the upper portion B of the sealing sheet 12 are not especially limited, but a heat seal is efficient. Industrially, the sealing can be performed in an automatic packing line.

The sealed package can be opened easily by peeling the fastener 15 between the sheet 11-*b* of the package body and the sealing sheet 12, and the peelable bonding portions 13 and/or 14, without requiring a device such as scissors. According to the present invention, a flap 16 or the like can be formed above the peelable bonding portion 13 as required.

Figure 3:
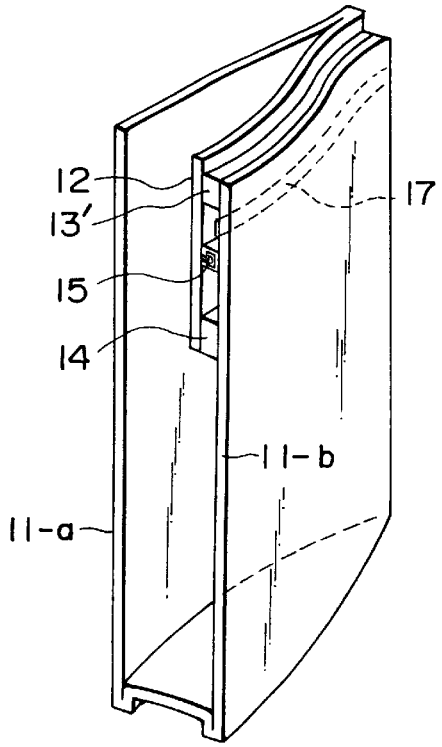
FIG. 3 is a cross-sectional view of the standing pouch provided with a tear line according to the present invention.

Another embodiment of the present invention is shown in FIG. 3. FIG. 3 is a cross-sectional view of the standing pouch provided with a tear line according to the present invention. In FIG. 3, a bonding portion 13' which is, or is not, difficult to be peeled is utilized at the upper side instead of the peelable bonding portion 13. The bonding portion 13' can be formed by a known means such as a heat seal. In this embodiment, a tear line 17 can be disposed between the fastener 15 and the bonding portion 13'. When the tear line 17 is disposed, the sheet 11-*b* of the package body is stretched uniaxially, imparting an orientation such that the sheet can be torn easily. Moreover, various means such as a tearing notch, perforation or a tearing tape can also be applied.

Figure 4:
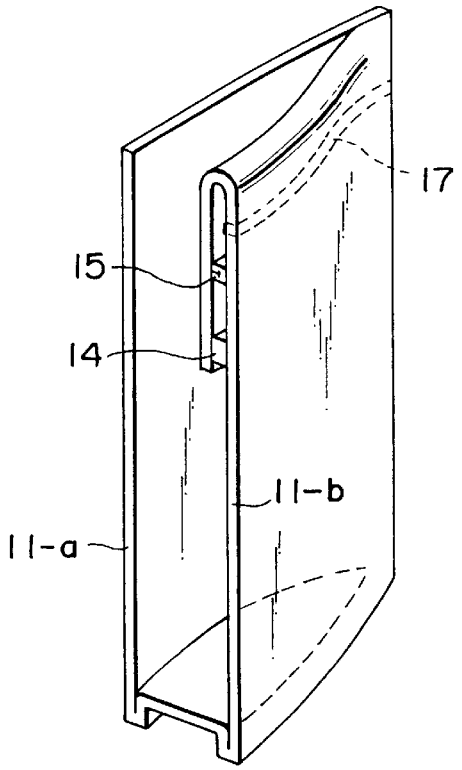
FIG. 4 is a cross-sectional view of another standing pouch provided with a tear line according to the present invention.

Still another embodiment of the present invention is shown in FIG. 4. FIG. 4 is a cross-sectional view of another standing pouch provided with a tear line according to the present invention. In FIG. 4, the sealing sheet 12 is replaced by folding the sheet 11-*b* of the package body. In this case, the tear line 17 can be formed above the fastener 15.

In the embodiments of the package shown in FIGS. 3 and 4, an inlet portion of the package body which is sealed after filling the contents has to merely be disposed merely above the tear line. In sealing, three sheets, the sheets 11-*a*, 11-*b* of the package body and the sealing sheet 12, can be heat sealed together resulting in efficient sealing.

In the case of a conventional large volume simple plastic package, for example, a gusseted bag, a standing pouch, a laminated paper pack and the like, a bottom of the package has a complex structure and the contents cannot be filled therefrom. Accordingly, in the conventional large volume plastic package, the contents have to be filled from an inlet side of the package. Therefore, in practice, a plastic package with a resealable fastener is rarely used due to fastener contamination.

According to the present invention, the sealing sheet 12 is utilized, and the fastener is kept engaged or the peelable bonding portion 14 is further formed at the content side of the fastener 15, thereby ensuring protection of the fastener 15. As a result, the contents can be filled from the inlet side of the package.

Also, it was found that durability against the internal pressure of the package further increases when the portion A of the sheet 11-*a* and the portion B of the sealing sheet 12 are sealed at least 2 mm above the end of the content side of the peelable bonding portion 14 or 13. The reason for this is not apparent, but it is assumed that the internal pressure may directly affect the peelable bonding portion 13 or 14 when the distance is less than 2 mm, while the internal pressure may be directly applied to the sealed portion between A and B, thereby significantly reducing stress on the peelable bonding portion 13 or 14, when the distance is 2 mm or more.

DESCRIPTION OF THE PREFERRED EMBODIMENTS

An Embodiment of the present invention and a Comparative Embodiment are given below by way of illustration.

(Embodiment)

A plastic package with a fastener shown in FIG. 1 was fabricated.

The package was a standing pouch having a width of 140 mm and a height of 150 mm, and a plastic fastener was formed at an inlet side as shown in FIG. 1. The material of a sheet 11-*a* and 11-*b* of a package body was a lamination of a polyester film having a thickness of 12 μm, a polyamide film having a thickness of 15 μm and a non-stretched polypropylene film having a thickness of 60 μm in that order from the outside in, and the respective layers were adhered by using a retort two component curing urethane type dry laminate adhesive therebetween. A sealing sheet was a lamination of a non-stretched polypropylene film having a thickness of 60 μm, a polyester film having a thickness of 12 μm, a polyamide film having a thickness of 15 μm and a non-stretched polypropylene film having a thickness of 60 μm, and the respective layers were dry-laminated by using a two component curing urethane type dry laminate adhesive therebetween.

On the sheet 11-*b* of the package body and the sealing sheet 12, a fastener made of non-stretched polypropylene was formed over the entire width of the package. At both sides of the fastener, a polyethylene modified polypropylene resin was part coated parallel to and 1 mm apart from the fastener in 5 mm a width. The fastener was then engaged and a bonding portion of a peelable resin and a bottom portion were bonded using a package making machine to fabricate a standing pouch.

The standing pouch was filled with 390 g of water from the inlet portion between the sheet 11-*a* and the sealing sheet 12. The sheet 11-*a* and the sealing sheet 12 were then heat sealed in a width of 5 mm at 3 mm above the bonding portion of the peelable resin of an upper portion of the fastener. The pouch was retorted by heating in hot water (100° C.) for 10 minutes. A heat seal strength between the sheet 11-*a* and the sealing sheet 12 and a heat seal strength of the peelable resin at a contents side were measured in accordance with the method in JIS Z-0238. The results were 2.1 kgf/15 mm and 0.4 kgf/15 mm, respectively. Further in accordance with the JIS Z-0238 method, a leak test was conducted after applying a compression load of 40 kgf. The test results are given in Table 1.

(Comparative Embodiment)

Figure 5:
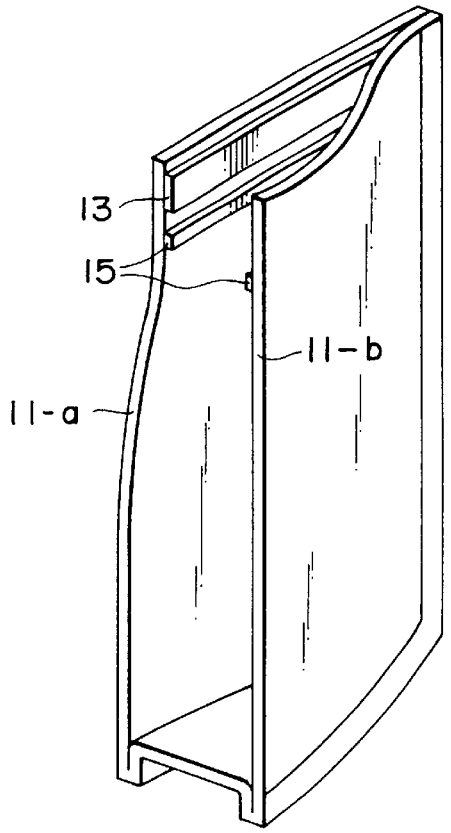
FIG. 5 is a cross-sectional view of a conventional standing pouch.

As a comparative embodiment, the standing pouch shown in FIG. 5 was fabricated.

The standing pouch had a width of 140 mm and a height of 150 mm, and a plastic fastener 15 and a peelable bonding portion 13 were formed at an inlet side as shown in FIG. 5. No peelable bonding portion was formed at the contents side lower than the fastener unlike the above-described Embodiment. No sealing sheet was used. The material of the package was identical to the above-described Embodiment.

On the inside of sheets 11-*a* and 11-*b* of the package, a fastener made of non-stretched polypropylene was formed. At an inlet side of the fastener, a peelable polyethylene modified polypropylene resin was part coated parallel to and 1 mm apart from the fastener in a 5 mm width. A bottom portion was bonded to fabricate the standing pouch. The standing pouch was filled with 390 g of water from the inlet portion between the sheets 11-*a* and 11-*b*. The fastener was engaged and the peelable resin was heat sealed. The pouch was retorted by heating at 100° C. for 10 minutes. The heat seal strength of the peelable resin was measured. The result was 0.4 kgf/15 mm.

Further in accordance with the JIS Z-0238 method, a leak test was conducted by applying a compression load of 40 kgf. The test results are given in Table 1.

TABLE 1

| Times Repeated | Embodiment | Comparative Embodiment |
|---|---|---|
| 1 | no leak | outburst from the peelable heat-sealed portion |
| 2 | no leak | outburst from the peelable heat-sealed portion |
| 3 | no leak | outburst from the peelable heat-sealed portion |
| 4 | no leak | outburst from the peelable heat-sealed portion |
| 5 | no leak | outburst from the peelable heat-sealed portion |
| 6 | no leak | outburst from the peelable heat-sealed portion |
| 7 | no leak | outburst from the peelable heat-sealed portion |
| 8 | no leak | outburst from the peelable heat-sealed portion |
| 9 | no leak | outburst from the peelable heat-sealed portion |
| 10 | no leak | outburst from the peelable heat-sealed portion |

As is apparent from the above, the plastic package of the present invention has excellent durability against internal pressure and is opened easily. In contrast, the plastic package with the fastener having merely the peelable bonding portion shows poor results and is difficult to be used in a large package such as a gusseted bag and standing pouch.

INDUSTRIAL APPLICABILITY

The plastic package with the fastener of the present invention has excellent filling, opening and resealing characteristics even if the contents are liquid, and excellent pressure resistance that allows a large volume of contents to be filled, as well as, excellent transportation stability and shelf-life. In addition, the package of the present invention is light-weight and cheap, and the contents can be filled from the inlet side regardless of the fastener and can be used in large packages such as gusseted bags and standing pouches.

What is claimed is:

1. A package comprising:

a flexible package body having a first side and a second side;

a sealing sheet disposed in an internal portion of the package body; and a fastener interposed between the first side of the package body and the sealing sheet for opening and closing an inlet portion of the package body, wherein the first side of the package body and the sealing sheet are bonded by a peelable bonding portion at a side of the package more internal than the fastener, and the second side of the package body and the sealing sheet are sealed at a portion that is at least 2 mm above an internal side of the peelable bonding portion.

2. A package comprising:

a flexible package body having a first side and a second side;

a sealing sheet disposed in an internal portion of the package body; and a fastener interposed between the first side of the package body and the sealing sheet for opening and closing an inlet portion of the package body, wherein the first side of the package body and the sealing sheet are bonded by a peelable bonding portion at a side of the package more external than the fastener, and the second side of the package body and the sealing sheet are sealed at a portion that is at least 2 mm above an internal side of the peelable bonding portion.

3. A package comprising:

a flexible package body having a first side and a second side:

a sealing sheet disposed in an internal portion of the package body; and a fastener interposed between the first side of the package body and the sealing sheet for opening and closing an inlet portion of the package body, wherein the first side of the package body and the sealing sheet are bonded by peelable bonding portions at sides of the package both external and internal of the fastener, and the second side of the package body and the sealing sheet are sealed at a portion that is at least 2 mm above internal sides of the peelable bonding portions.

4. A package according to claim 1, wherein the peelable bonding portion is disposed parallel to the fastener.

5. A package according to claim 1, wherein a tear line is disposed between the fastener and a seal between the first side of the package body and the sealing sheet.

6. A package according to claim 1, wherein a distance between the fastener and the peelable bonding portion is at least 0.5 mm.

7. A package according to claim 1, wherein the package is one of a gusseted bag, a standing pouch, and a laminated paper pack.

8. A method for filling contents into a package comprising the steps of:

filling the contents from an inlet side of the package according to claim 1; and sealing a second side of a package body and a sealing sheet.

9. A package according to claim 2, wherein the peelable bonding portion is disposed parallel to the fastener.

10. A package according to claim 2, wherein a tear line is disposed between the fastener and a seal between the first side of the package body and the sealing sheet.

11. A package according to claim 2, wherein a distance between the fastener and the peelable bonding portion is at least 0.5 mm.

12. A package according to claim 2, wherein the package is one of a gusseted bag, a standing pouch, and a laminated paper pack.

13. A method for filling contents into a package comprising the steps of:

filling the contents from an inlet side of the package according to claim 2; and sealing a second side of a package body and a sealing sheet.

14. A package according to claim 3, wherein the peelable bonding portions are disposed parallel to the fastener.

15. A package according to claim 3, wherein a tear line is disposed between the fastener and a seal between the first side of the package body and the sealing sheet.

16. A package according to claim 3, wherein a distance between the fastener and each of the peelable bonding portions is at least 0.5 mm.

17. A package according to claim 3, wherein the package is one of a gusseted bag, a standing pouch, and a laminated paper pack.

18. A method for filling contents into a package comprising the steps of:

filling the contents from an inlet side of the package according to claim 3; and sealing a second side of a package body and a sealing sheet.

* * * * *